US012540016B2

(12) United States Patent
Nguyen

(10) Patent No.: US 12,540,016 B2
(45) Date of Patent: Feb. 3, 2026

(54) METHOD FOR SCENTING BOTANICALS IN A DISPLAY JAR USING A CLOSABLE VENT

(71) Applicant: Huy Nguyen, Fountain Valley, CA (US)

(72) Inventor: Huy Nguyen, Fountain Valley, CA (US)

( * ) Notice: Subject to any disclaimer, the term of this patent is extended or adjusted under 35 U.S.C. 154(b) by 0 days.

(21) Appl. No.: 18/590,935

(22) Filed: Feb. 28, 2024

(65) Prior Publication Data

US 2024/0286806 A1 Aug. 29, 2024

Related U.S. Application Data

(60) Provisional application No. 63/448,823, filed on Feb. 28, 2023.

(51) Int. Cl.
*B65D 51/16* (2006.01)
*A47G 7/02* (2006.01)

(52) U.S. Cl.
CPC ..... *B65D 51/1683* (2013.01); *A47G 7/02* (2013.01)

(58) Field of Classification Search
CPC ... B65D 51/1672; B65D 51/1683; A47G 7/02
USPC ..... 47/41.01; 215/307
See application file for complete search history.

(56) References Cited

U.S. PATENT DOCUMENTS 1,796,014 A * 3/1931 Ferngren ..... A47F 3/145 141/369
2,997,397 A * 8/1961 Doulgheridis ..... B65D 51/16 426/118
5,115,975 A * 5/1992 Shilling ..... A61L 9/03 239/57
5,710,406 A * 1/1998 Garris ..... B60N 3/14 392/386
5,851,442 A * 12/1998 Spector ..... A61L 9/12 261/DIG. 65
9,788,669 B1 10/2017 Denby
11,964,078 B2 4/2024 Deghionno
2002/0030116 A1* 3/2002 Brown ..... B05B 11/1074 239/289
2004/0108338 A1* 6/2004 Patel ..... A61L 9/145 222/402.1
2005/0061812 A1* 3/2005 Vilalta ..... B65D 79/0087 220/212
2006/0237467 A1* 10/2006 Anderson ..... B65D 77/245 220/735
2010/0314461 A1* 12/2010 Gruenbacher ..... B60H 3/0028 239/6

(Continued)

FOREIGN PATENT DOCUMENTS

EP 2595894 7/2010
JP 2005000065 1/2005

*Primary Examiner* — Brady W Frazier
(74) *Attorney, Agent, or Firm* — Scott R Hansen; Viking IP Law

(57) ABSTRACT

A method of displaying a botanical in a display jar has a jar lid having an open and a closed position. The jar lid includes a mechanism that is biased toward the closed position. The jar lid has at least on vent on a side. The user depresses a center cap on top of the jar lid from the closed position to the open position. The vent is opened and aroma from inside the jar is released from the jar through the vent. The user then releases the center cap so that the lid returns to the closed position and the aroma is sealed within the jar until the vent is opened again.

10 Claims, 15 Drawing Sheets

(56) References Cited

U.S. PATENT DOCUMENTS

| | | | | |
|---|---|---|---|---|
| 2010/0320282 | A1* | 12/2010 | Sissom | A61L 9/042 239/34 |
| 2012/0120571 | A1* | 5/2012 | Bisesti | H01R 13/5841 361/679.01 |
| 2012/0217371 | A1* | 8/2012 | Abdollahzadeh | G08B 13/1463 248/551 |
| 2013/0068788 | A1* | 3/2013 | Gasper | B65D 83/386 222/144.5 |
| 2014/0260442 | A1* | 9/2014 | Brown | A45C 13/20 70/58 |
| 2014/0266723 | A1* | 9/2014 | Grant | G08B 13/1445 340/568.2 |
| 2019/0344935 | A1 | 11/2019 | Parle | |
| 2021/0085064 | A1* | 3/2021 | Khalsa | A45F 5/1533 |
| 2021/0261296 | A1* | 8/2021 | Safdie | B65D 23/003 |
| 2021/0322740 | A1* | 10/2021 | Wang | A61M 31/00 |

* cited by examiner

When vented center lid is pressed down - the sealing plate exposees an opening cavity in center of the jar lid allows aroma contained inside the jar to escape or pe rmenate through the same opening - ultimately passing through the vents of the center cap The lid locking screws are manuaally farstened to secure the lid to the glass jar so the contents inside the jar cannot be accessed by customers or unauthorized persons.

METHOD FOR SCENTING BOTANICALS IN A DISPLAY JAR USING A CLOSABLE VENT

The present application claims priority from U.S. Provisional Patent Application No. 63/448,823 entitled "DEVICE AND METHOD FOR SCENTING BOTANICALS" and filed Feb. 28, 2023 and which is incorporated by reference herein.

BACKGROUND

Displays for displaying *cannabis* or other botanicals are used in retail settings to showcase the products to customers. These displays may be designed to attract the attention of customers and to provide them with information about the products. In some cases, displays may include features that allow customers to smell the aroma of the contents of the jar.

There are several prior art references that describe displays for displaying *cannabis* or other botanicals that allow customers to smell the aroma of the contents of the jar. For example, U.S. Pat. No. 10,498,536 to Jones et al. discloses a display system for showcasing *cannabis* flower that includes a jar with a removable lid and a scent dome that can be used to allow customers to smell the aroma of the *cannabis* flower. The scent dome is positioned above the jar and can be lifted to allow the customer to smell the aroma of the contents.

U.S. Pat. No. 10,224,791 to Johnson et al., discloses a display system for showcasing *cannabis* flower that includes a jar with a lid that has a built-in scent diffusion system. The scent diffusion system includes a scent wick that can be impregnated with a scent and inserted into a scent well on the underside of the lid. The scent is then diffused through the lid to allow the customer to smell the aroma of the *cannabis* flower.

There is a need for an improved display for displaying *cannabis* or other botanicals in a jar that allows a customer to smell the aroma of the contents of the jar, while also preserving the freshness of the contents and providing an aesthetically pleasing display. The present invention addresses these and other needs.

SUMMARY OF THE INVENTION

Embodiments of the present disclosure may include a method of displaying a botanical or other contents in a display jar, the jar having a top that has an open position and a closed position, the top being biased toward the closed position, the method including the steps of depressing at least a portion of the top of the display jar from the closed position to the open position, whereupon at least one vent in the side of the top may be opened and aroma from inside the jar may be released from the jar through the vent. Embodiments may also include releasing the at least a portion of the top so that it returns to the closed position. In some embodiments, the vent may be closed and the aroma may be sealed within the jar until the vent is opened again.

Embodiments may also include at least a portion of the jar may be transparent, and the method includes placing contents within the jar such that the contents within the jar may be visible from outside of the jar. In some embodiments, the portion of the jar that may be transparent extends about 360 degrees about the circumference of the jar. In some embodiments, the top includes a spring-loaded center sealing plate.

In some embodiments, the at least a portion of the top includes a vented center cap which, when depressed, opens the at least one vent in the side of the top. In some embodiments, the jar may be secured to a surface with a tether. In some embodiments, the jar has a base ring with an opening, the tether being secured to the base ring at the opening. In some embodiments, the tether may be secured to a base portion of the jar. In some embodiments, the tether may be secured to or adjacent to the top of the jar. In some embodiments, the method includes displaying the jar inside a case or other enclosed structure.

One embodiment includes a method where at least a portion of the jar is transparent, and the method includes placing contents within the jar such that the contents within the jar are visible from outside of the jar. The portion of the jar that is transparent extends about 360 degrees about the circumference of the jar. The top includes a spring-loaded center sealing plate. The at least a portion of the top includes a center cap which, when depressed, opens at least one vent in the side of the top. The jar is secured to a surface with a tether. The jar has a base ring with an opening, the tether being secured to the base ring at the opening. The tether is secured to a base portion of the jar. The tether is secured to or adjacent to the top of the jar. The method may include displaying the jar inside a case or other enclosed structure.

The foregoing and other objects, features, and advantages of the invention will become more apparent from the following detailed description, which proceeds with reference to the accompanying figures.

DETAILED DESCRIPTION

With reference to the attached drawings, in one embodiment, a remedy display jar offers an aesthetically pleasing way to view botanicals, such as dried herbs, flowers, fruits, as well as *cannabis*-related products such as dried *cannabis* flower, *cannabis* joints, *cannabis* cigars, concentrated extracts or small food items (e.g. candies that have been infused with *cannabis* extracts). In one embodiment, the view is a full 360 degrees about the circumference of the display. Additionally, a potential customer may smell the aromas of the contents stored inside the glass jar through a top-vented or side-vented center cap.

The display jar may provide store owners/operators, including legal stores displaying botanicals and/or in other types of stores displaying other types of materials, the ability to display and market the products, to be viewed/studied, inspected, and or smelled by customers before making purchases. As examples only, the jar may be secured or unsecured with:

- A security tether (anchored at the base ring where there is a hole)
- A security tether with an adhesive that can be applied to the base of the glass jar (no base ring needed)
- A security tether (applied/screwed into the side of the lid)
- No security tether (e.g. jar is displayed behind a case or partition of choice etc).

Examples of Functionality

- Customers can hold the jar and push down on the top-vented center cap/button to smell the contents contained in the jar.
- When the top-vented center cap/button is pushed down, a spring-loaded "sealing" plate will move down and reveal a center or side opening in the lid that will
  - Allow air or aromas contained in the glass jar to pass through the center or side opening of the lid; and/or
  - Aromas will pass through a top-vented center cap A spring-loaded center sealing plate may function as a trap door to prevent aromas from readily permeating out of the jar when not in use and preserve jar contents as much as possible.

Figure 1:
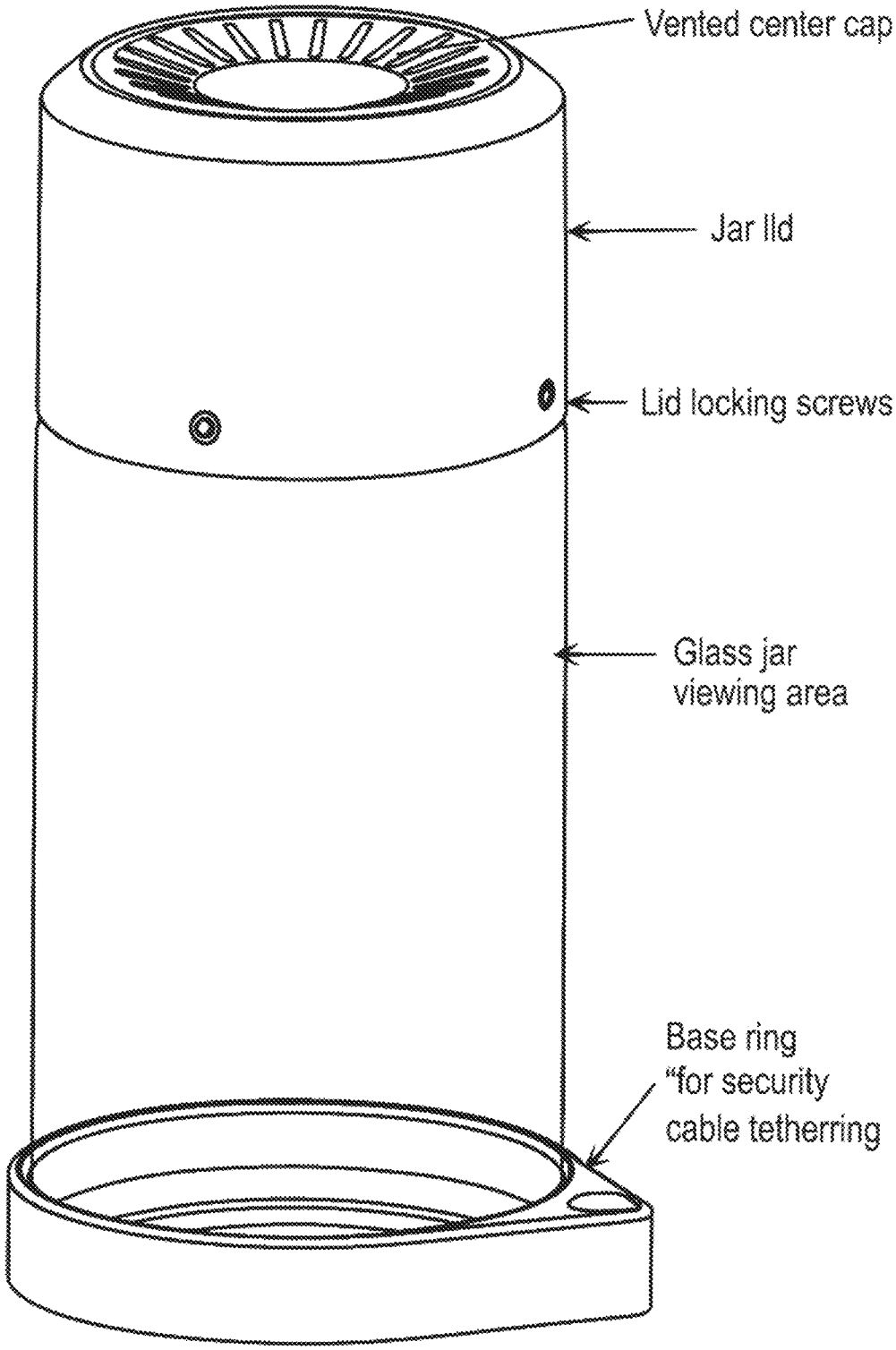
FIG. 1 is a side view of a display jar according to a first embodiment of the present invention.

FIG. 1 illustrates a first embodiment of a display assembly. The assembly includes a jar lid that has a vented center cap. The vented center cap has a plurality of openings that may be opened when a user pushes down on the vented center cap. The jar lid is held in place on a glass jar with lid locking screws. The glass jar viewing area is typically transparent such that a viewer may look through the glass jar into the interior to see a botanical placed inside. The glass jar may have a 360° view or, alternatively, may have a view that is less than 360°. For example the jar may have a viewing window that is transparent but the remainder of the jar may be translucent or opaque, depending on desired viewing properties. The base includes a ring that may optionally have an opening through which a cable may be tethered for security. This may be useful in settings in which there is a need to prevent the display from being taken.

Figure 2:
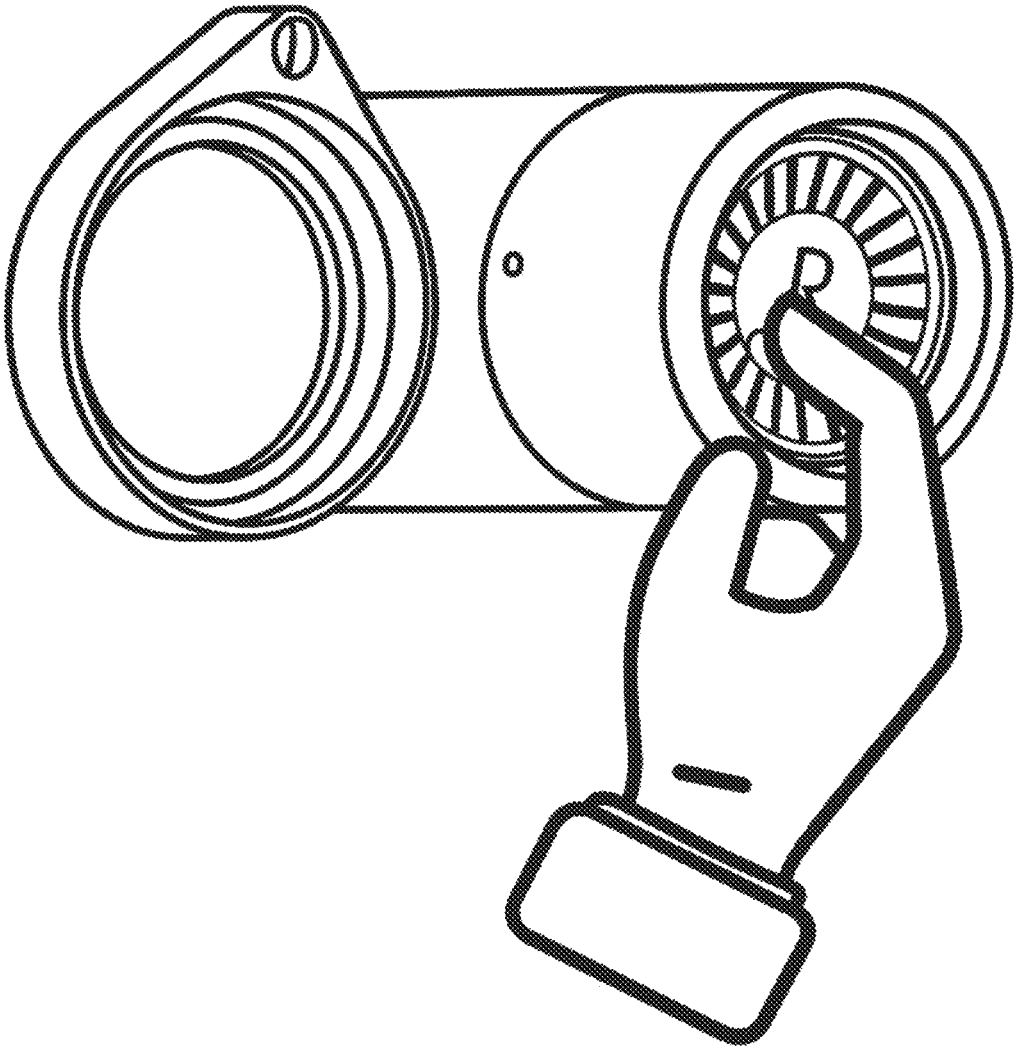
FIG. 2 is a perspective view of a user depressing a vented center cap to release scent from the interior of the jar.

FIG. 2 illustrates a user pushing down on a center portion or button of the vented center cap. As the user pushes down the button, the vented center cap is caused to open the plurality of vents. This allows scent from the interior of the glass jar viewing area to escape through the vents such that the user may smell the interior. Typically this means that if an aromatic botanical is stored within the jar, the user may now get a sample smell of what the botanical smells like. This can be useful for applications such as smelling dried flowers or for various uses in the *cannabis* industry as described previously.

It should be noted that in FIG. 2 the vents are on top of the vent cap. However in an alternative design that will be discussed below, one or more vents may be provided on the side of the cap rather than on the top. Or, in a further embodiment, the vents may be provided both on the top and on the side of the vent cap.

Figure 3:
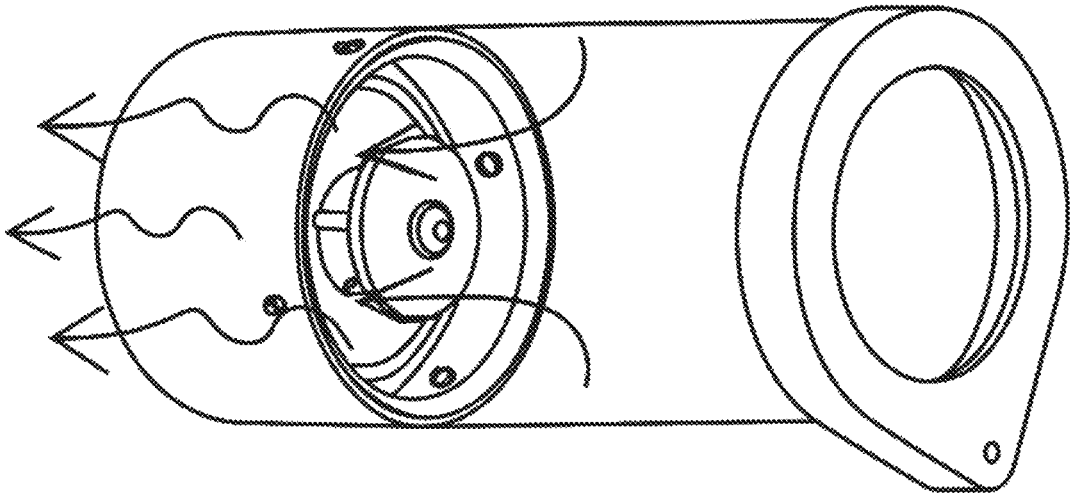
FIG. 3 illustrates scent flowing from the interior of the jar to the exterior where a user may smell the scent.
Figure 4:
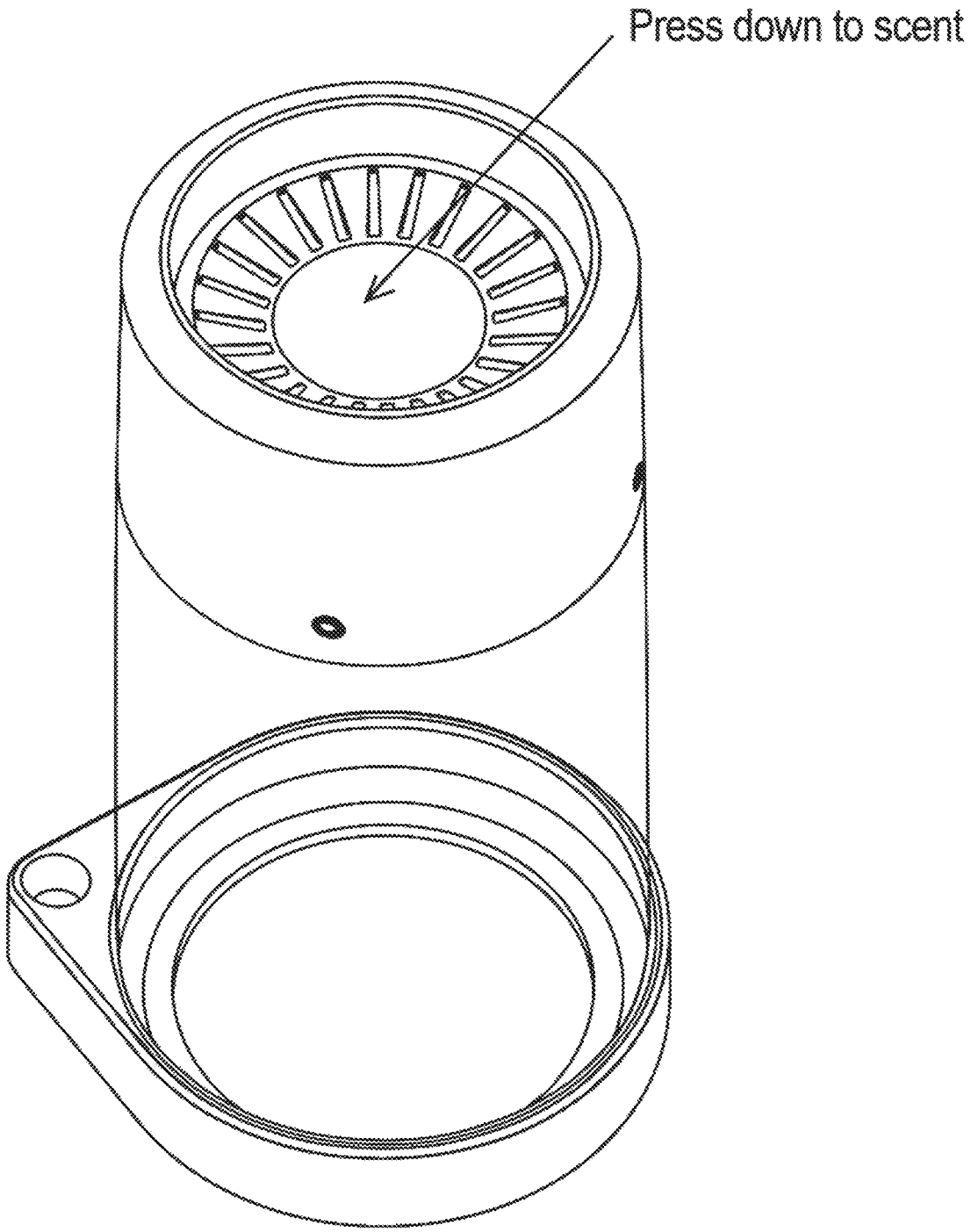
FIG. 4 is a further view of a jar according to the first embodiment.

FIG. 3 illustrates scent from the interior of the jar flowing up through the jar and ultimately through vents in the top of the cap. When the user is done sniffing the botanicals stored within the jar, the user will release the button on the vent cap to allow the button to return to the closed position to which it is biased. That is, the normal position of the vents is the closed position and the vents only open when the user pushes down on the button. Once the user has released the button, the button and associated vents return to the upper position at which the vents are closed, so the scent cannot escape the jar.

Figure 5:
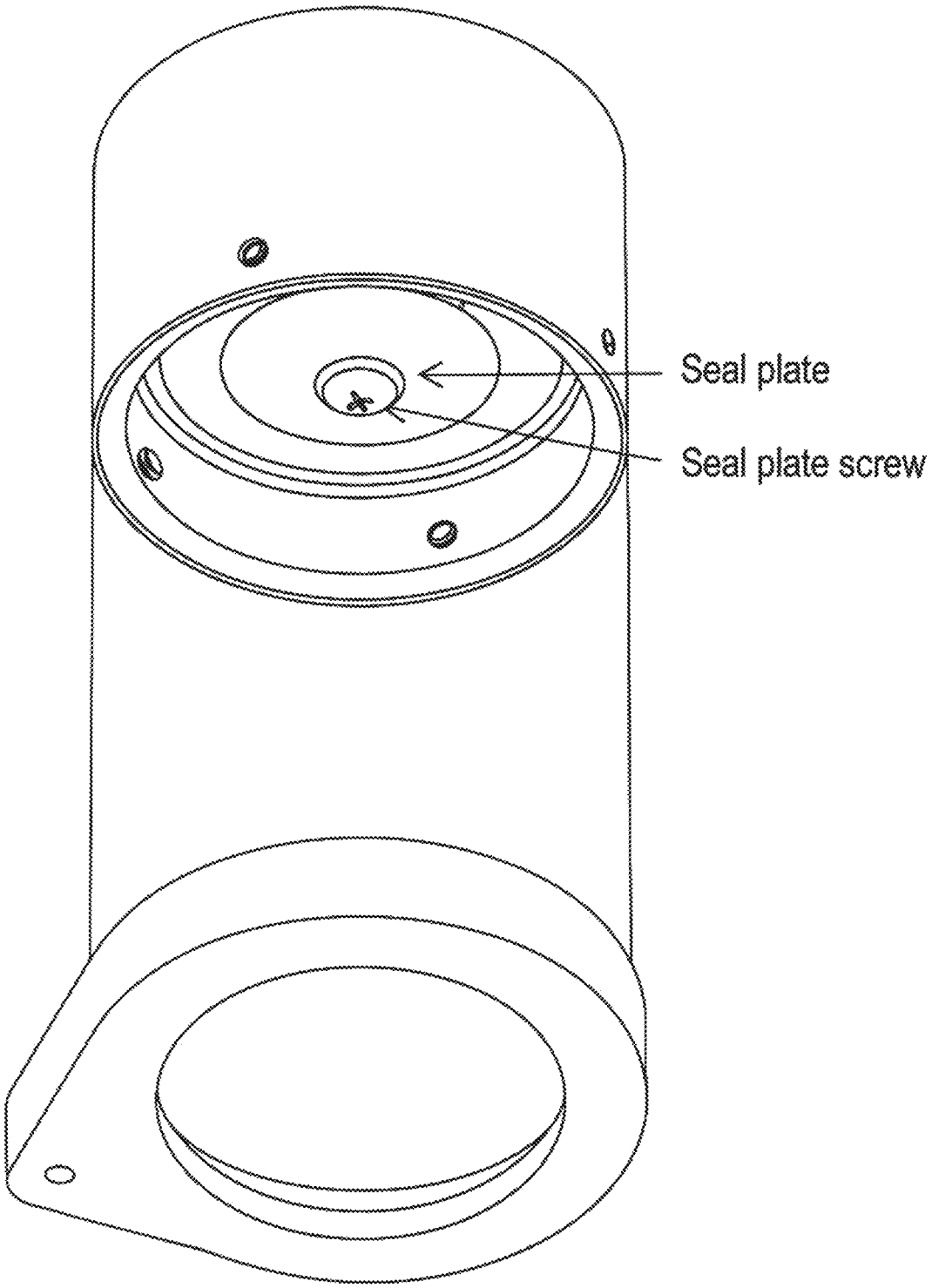
FIG. 5 illustrates components of the underside of the lid assembly.

FIG. 5 illustrates the underneath portion of the vent button. A seal plate Is held into place with a seal plate screw. As the user pushes down on the button. The seal plate moves down creating paths through which sent can escape. When vented center lid is pressed down, the ceiling plate exposes an opening cavity in the center of the jar lid and allows aroma contained inside the jar to escape or permeate through the same opening, ultimately passing through the vents of the subject cap.

Figure 6:
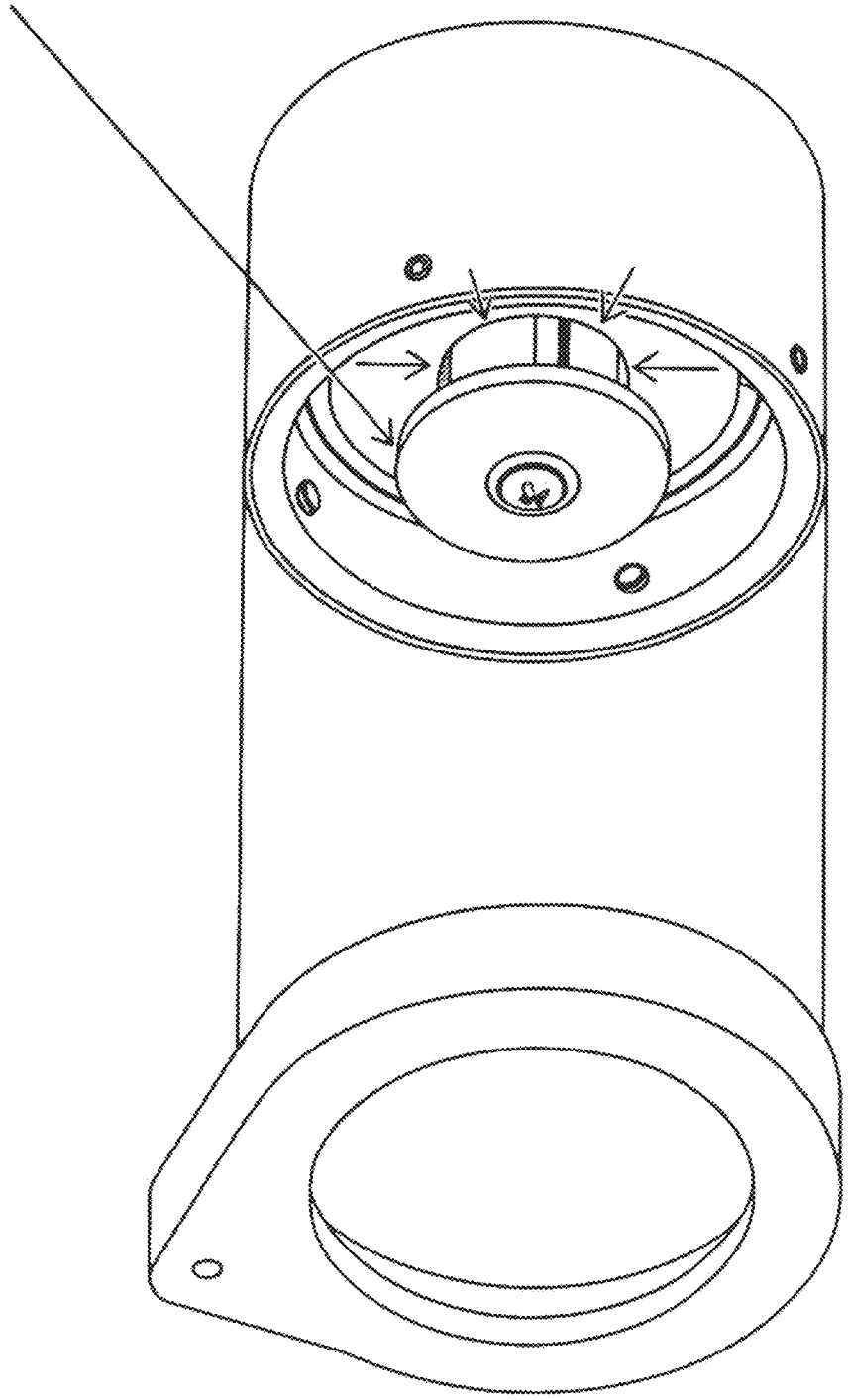
FIG. 6 illustrates the components of FIG. 5 as they appear when the user has pushed down on the vented center cap.

FIG. 6 is an exploded view of components of this embodiment of the jar. The lid locking screws are manually fastened to secure the lid to the glass jar so that the contents inside the jar cannot be accessed by customers or unauthorized persons.

Figure 7:
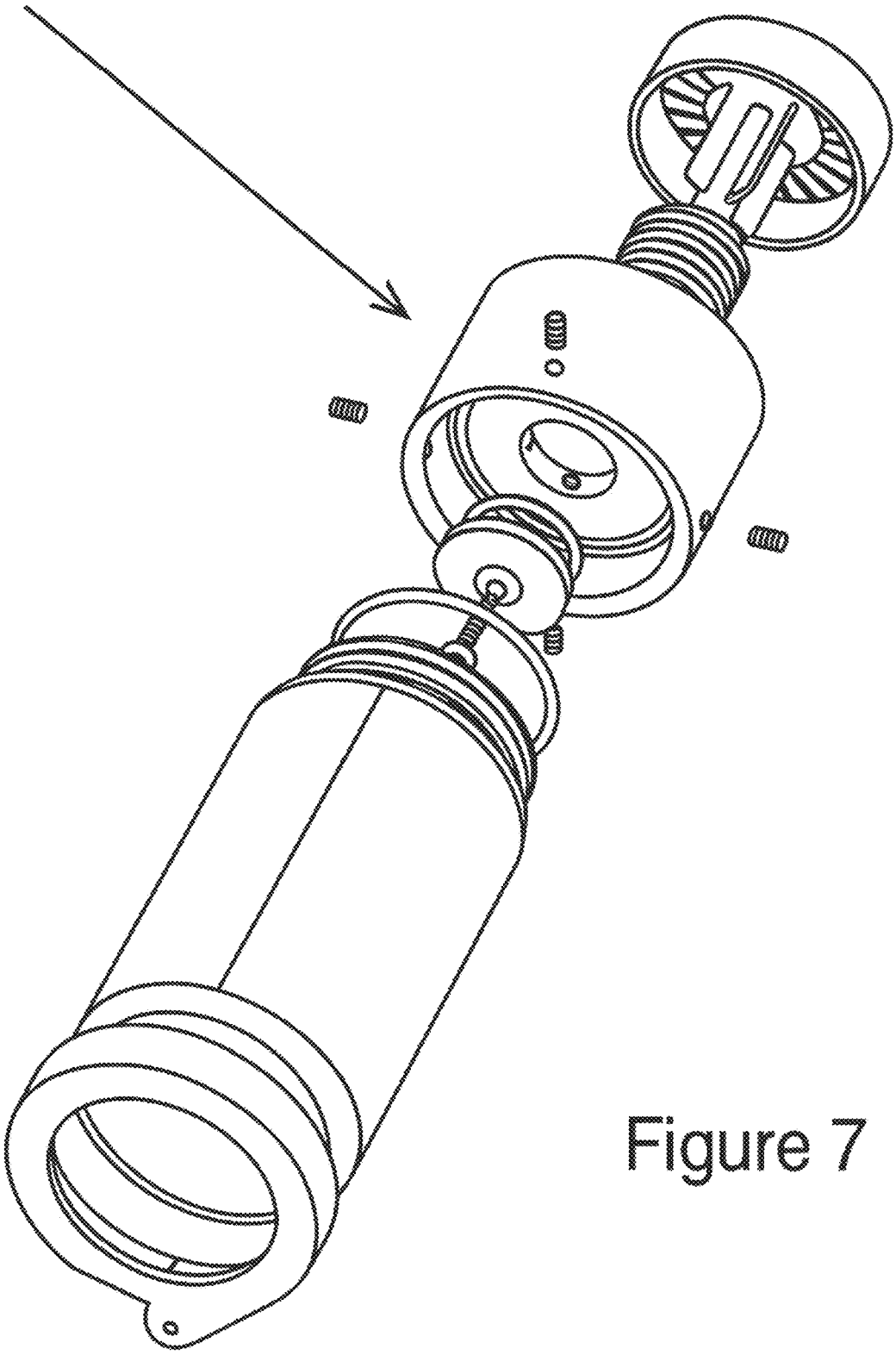
FIG. 7 is an exploded view of components of the first embodiment.

FIG. 7 illustrates individual components of the jar assembly. A vented center cap assembly includes a compression spring which biases the vented center cap upwards into what will be a closed position. The compression spring also pulls the ceiling plate back into place, such that the assembly is auto closing. The vented center cap fits atop a jar lid. The jar lid is held into place with lid locking screws a seal plate o-ring and a seal plate are held into place with a steel plate screw. And o-ring may then be placed on the jar itself. The jar includes a glass jar viewing area. And, at the very bottom, there is a base ring which may be provided with a opening through which a tethering cable may be run.

Figure 8:
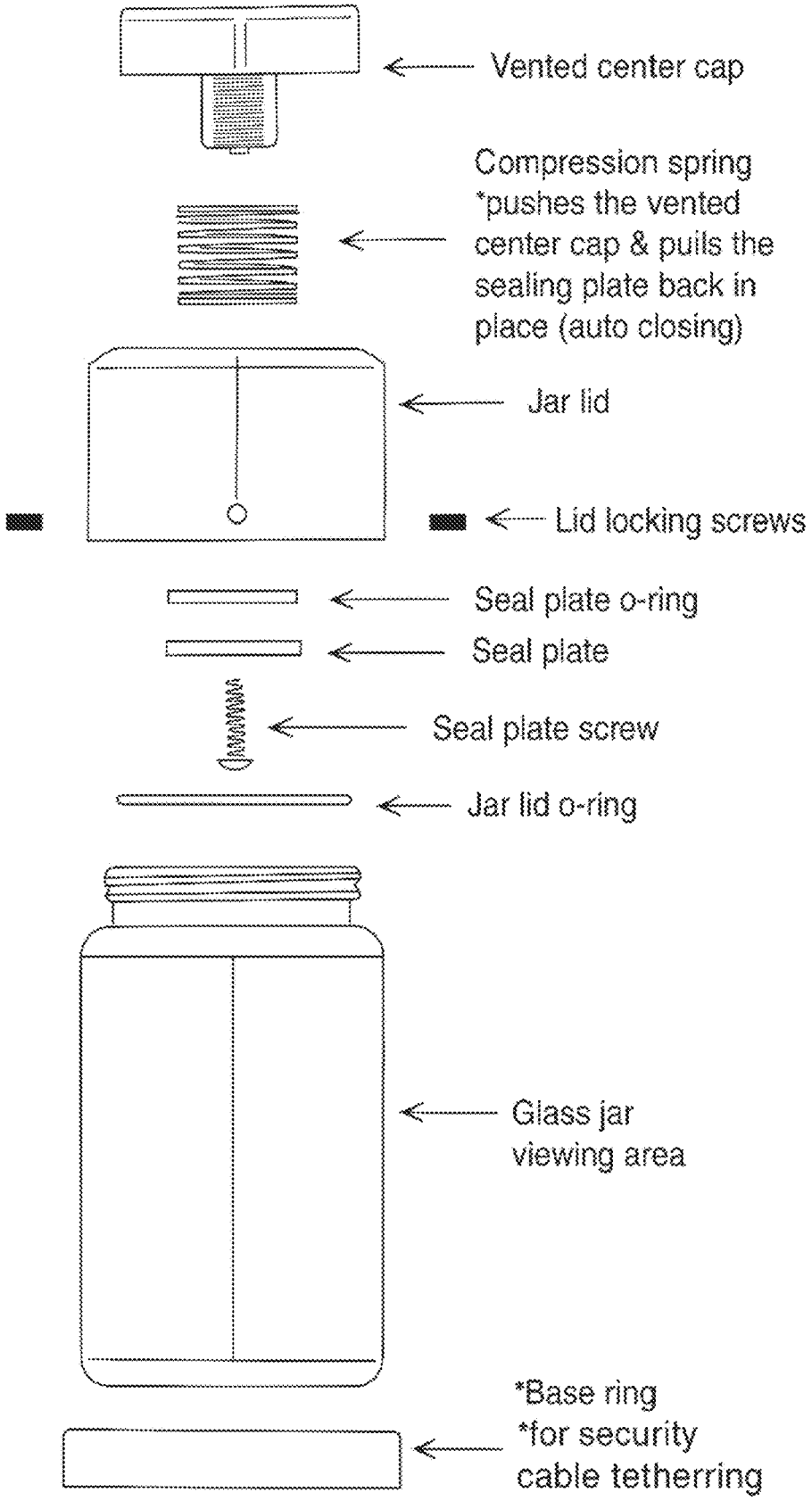
FIG. 8 is a further exploded view of the components of the first embodiment.

FIG. 8 illustrates the jar on a display stand. The display stand may include, for example, a light source to illuminate the interior of the glass jar for viewing. The display may also include a tether cable, which can be further seen in FIG. 9. If a user were to attempt to take the jar away, the tether cable word prevent the jar from moving very far.

Considering now a method of displaying a botanical or other contents in a display jar, according to some embodiments of the present disclosure. The method may include depressing at least a portion of the top of the display jar from the closed position to the open position, whereupon at least one vent in the jar top may be opened and aroma from inside the jar may be released from the jar through the vent. The method may include releasing the at least a portion of the top so that it returns to the closed position. The top may have an open position and a closed position, the top being biased toward the closed position. The vent may be closed and the aroma may be sealed within the jar until the vent is opened again.

In an alternative embodiment, the vent or vents may be provided in the side of the jar lid, instead of or in addition to, vents on the top of the lid.

In some embodiments, at least a portion of the jar may be transparent. The method may include placing contents within the jar such that the contents within the jar may be visible from outside of the jar. In some embodiments, the portion of the jar that may be transparent extends about 360 degrees about the circumference of the jar. In some embodiments, the top may include a spring-loaded center sealing plate.

In some embodiments, the at least a portion of the top may include a top-vented center cap which, when depressed, opens the at least one vent in the top. In other embodiments, the at least one vent may be provided in the side of the jar lid, as will be discussed below.

In some embodiments, the jar may be secured to a surface with a tether. In some embodiments, the jar may have a base ring with an opening, the tether being secured to the base ring at the opening. In some embodiments, the tether may be secured to a base portion of the jar. In some embodiments, the tether may be secured to or adjacent to the top of the jar. In some embodiments, the method may include displaying the jar inside a case or other enclosed structure.

Figure 9:
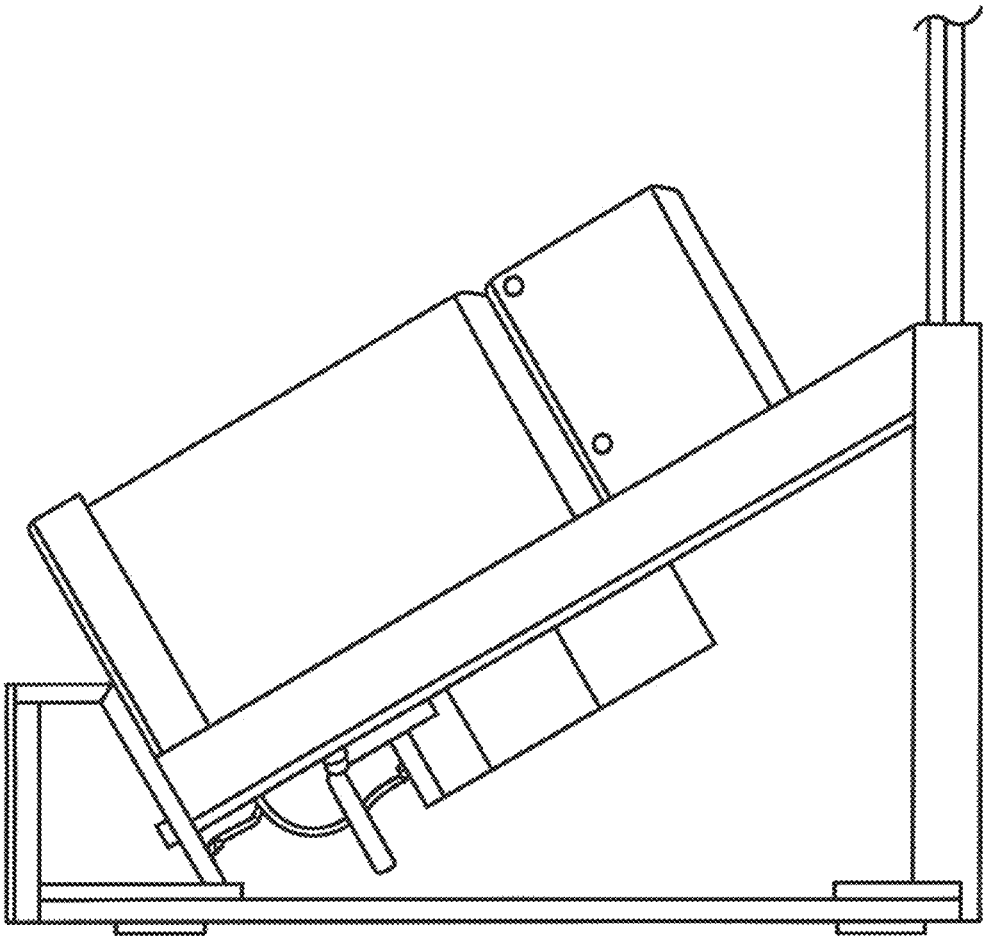
FIG. 9 illustrates a display jar of the present invention on a display.

FIG. 9 illustrates a second embodiment in which an opening or openings are not provided at the top of the cap assembly, but are rather provided in the side of the jar lid. FIG. 9 illustrates just one opening, although a plurality of openings add different points on the side of the jar lid may be provided.

Figure 10:
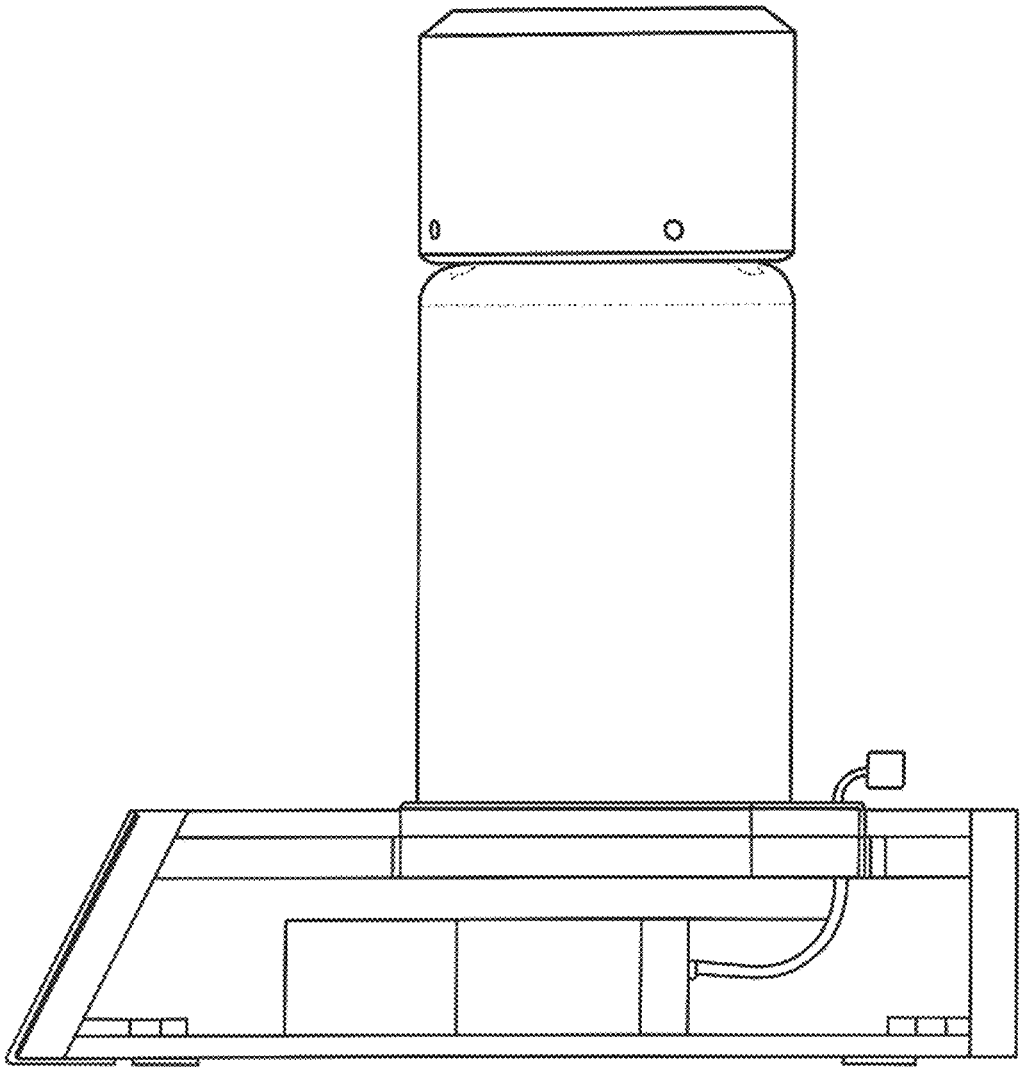
FIG. 10 illustrates a display jar tethered to a display to prevent theft of the jar.

As in the first embodiment, the default status of the side opening is to be closed. That is sent cannot escape from the jar unless the user takes action to open the opening. As with the first embodiment, the user opens the side opening by pushing down on a button. The opening then opens, until the user releases the button. FIG. 10 illustrates components of this embodiment. Again, bolts are provided to secure the lid onto the glass jar so that it is difficult for a user to reach into the jar and take the botanicals stored within.

Figure 11:
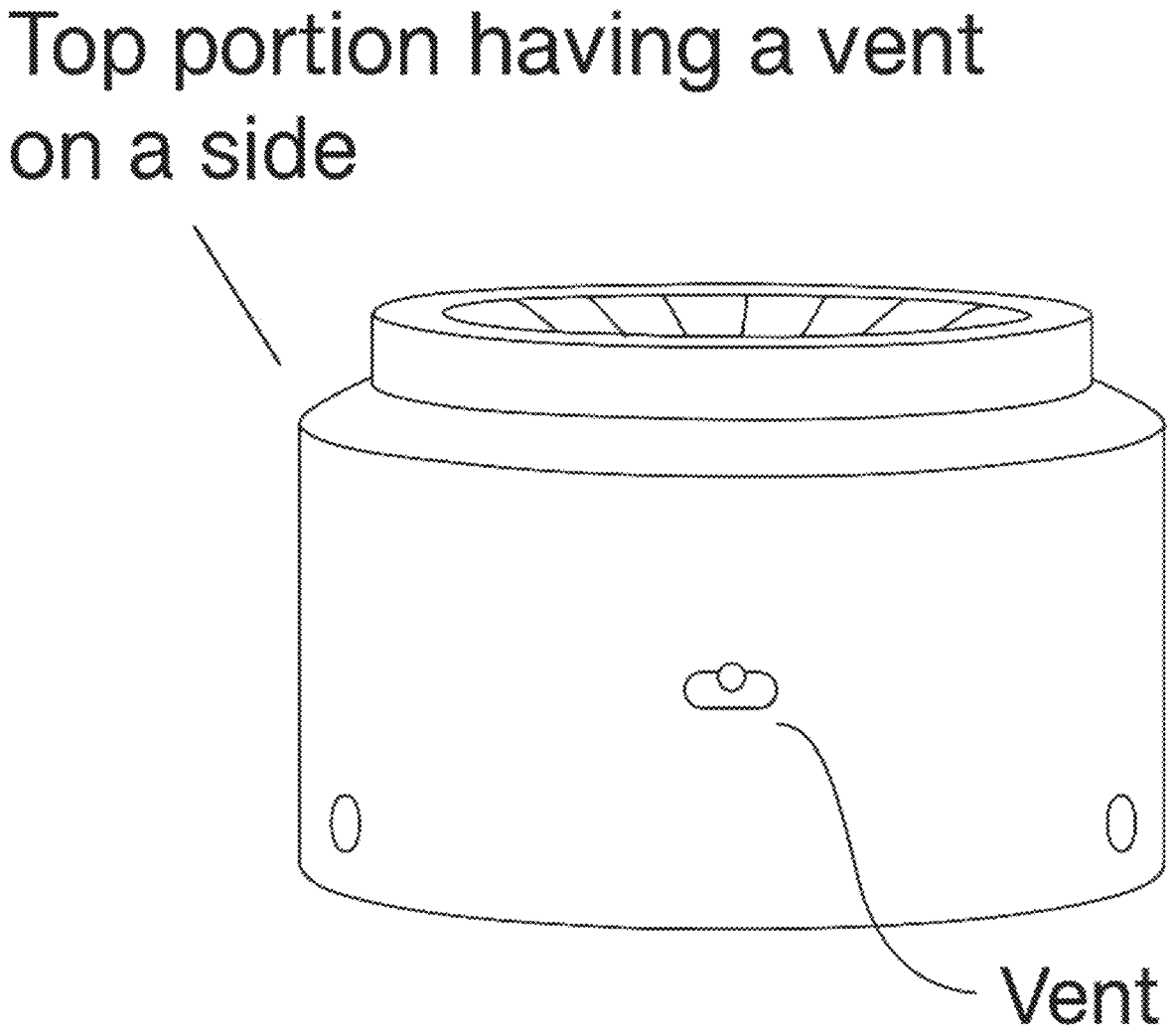
FIG. 11 a jar lid according to a second embodiment of the present invention, in which at least one scent opening in provided in the side of the lid rather than on the top of the lid.
Figure 12:
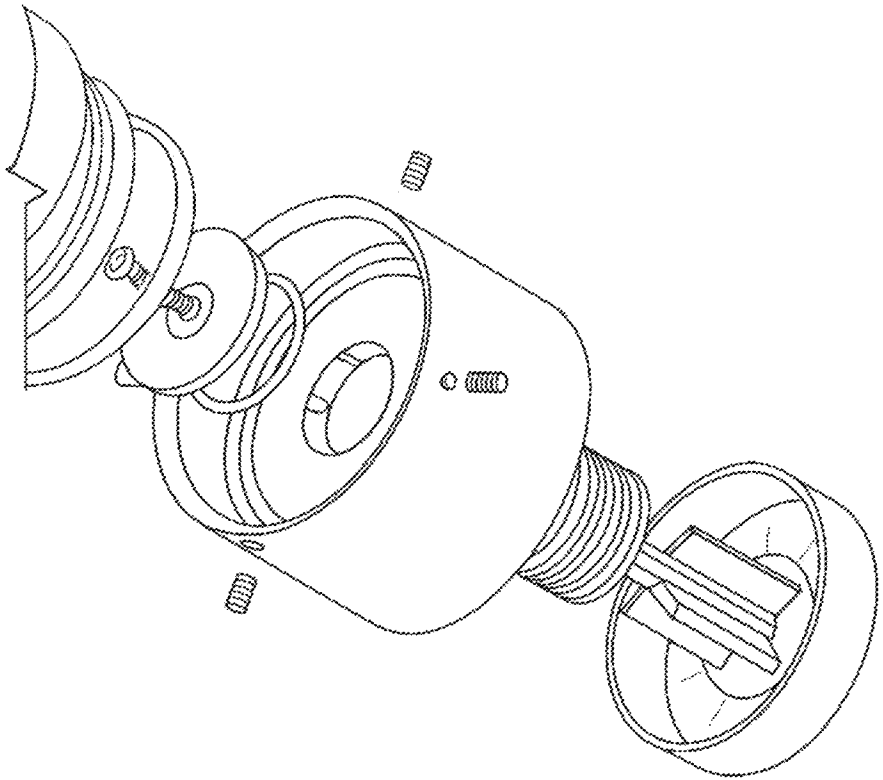
FIG. 12 is an exploded view of components of the second embodiment.
Figure 13:
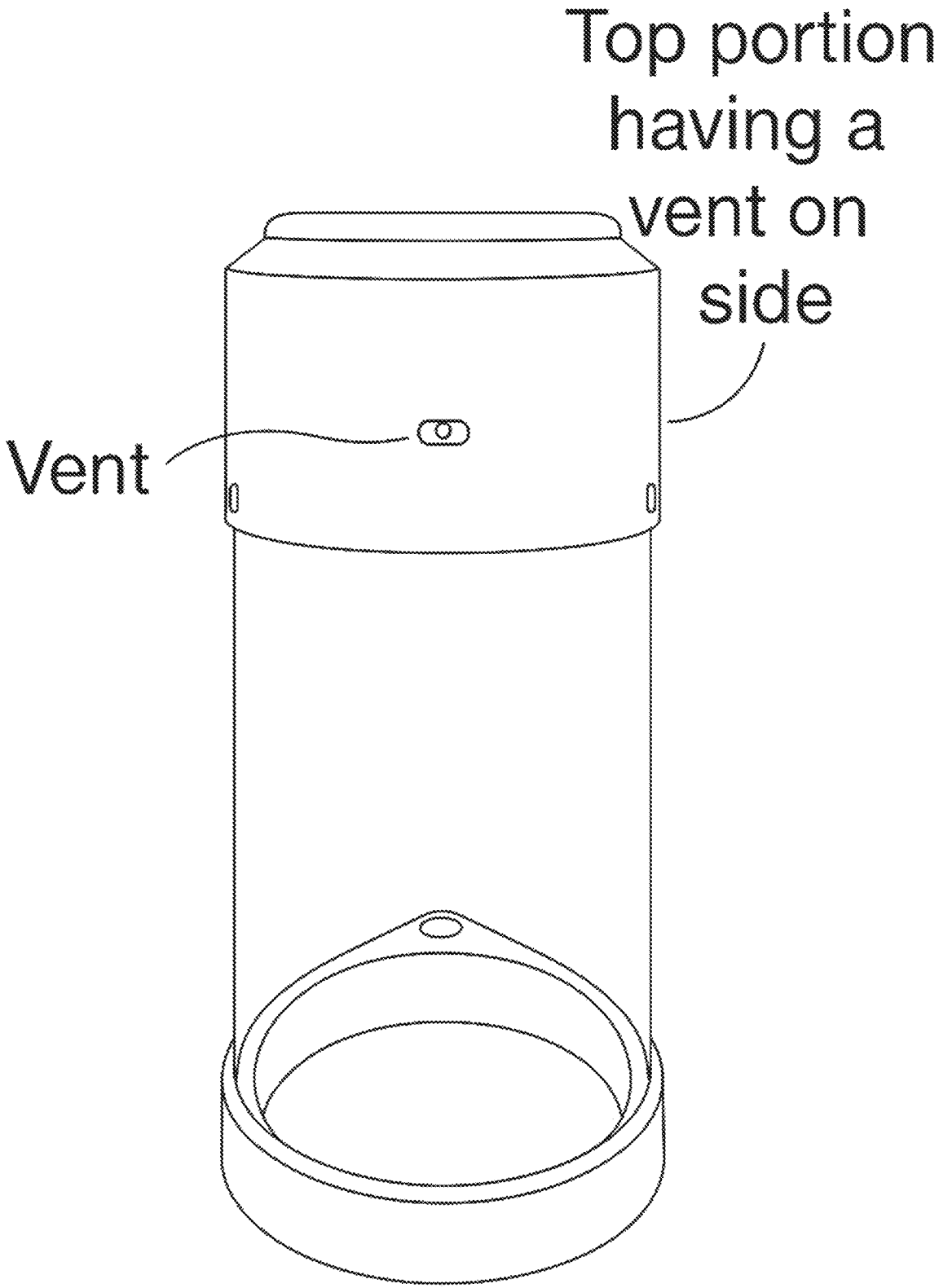
FIG. 13 is a side perspective view of one example of the second embodiment.
Figure 14:
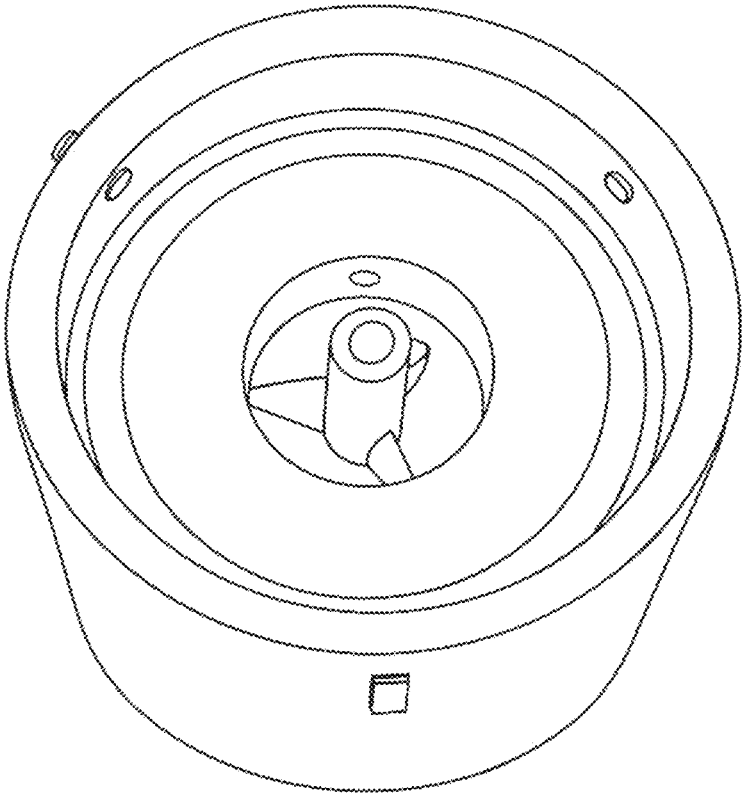
FIG. 14 a bottom view of the lid of the second embodiment in a first position.
Figure 15:
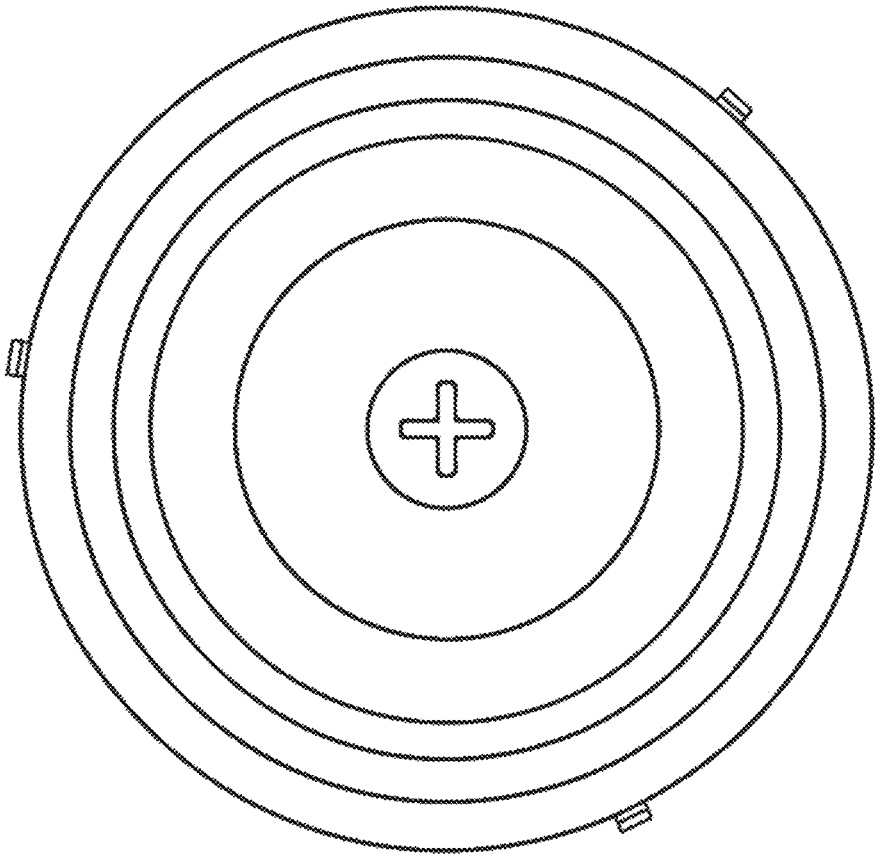
FIG. 15 is a bottom view of the lid in a second position

FIG. 11 illustrates that the jar of this second embodiment is similar in appearance to the previous embodiment. However, as noted, the opening through which scent travels to the exterior of the jar is on the side of the lid rather than on the top. FIG. 12 illustrates the lid as seen from below, in which a disk covers the side opening until a user pushes the disk out of the way of the opening. A flow path is provided for scent through the ring such that it can flow outside of the side opening when the ring isn't blocking the side opening. FIG. 13 is a further view of the underside of the mechanism.

It should be understood that the foregoing are merely illustrations of the invention, as embodied in specific examples. However, those skilled in the art will note that various alternatives may be made within the scope of the invention. Consequently the embodiments discussed herein are merely illustrative.

In view of the many possible embodiments to which the principles of the disclosed technology may be applied, it should be recognized that the illustrated embodiments are only preferred examples of the disclosure and should not be taken as limiting the scope of the disclosure. Rather, the scope of the disclosure is defined by the following claims. We therefore claim as our disclosure all that comes within the scope and spirit of these claims.

What is claimed is:

1. A method of visually and aromatically displaying botanical contents in a display jar, the jar having a top portion and a bottom display portion, the top portion having an open position and a closed position, the top portion being biased toward the closed position, the top portion having at least one vent on a side of the top portion, the method comprising:

depressing a portion of the top portion of the display jar from the closed position to the open position so as to move a sealing plate in a direction away from a bottom surface of the top portion, whereupon the vent on the side of the top portion is opened and aroma from inside the jar is released from the jar through the vent;

releasing the portion of the top portion so that it returns to the closed position in which the vent is closed and the aroma is sealed within the jar until the vent is opened again;

the bottom display portion being at least partially transparent and positioning the jar such that the botanical contents are visible through the transparent portion of the bottom display portion of the jar while the aroma is released;

wherein the method includes selectively releasing aroma through the at least one vent on the side of the top portion while the contents are visible such that a viewer can both see and smell the botanical contents.

2. The method of claim 1, wherein the portion of the jar that is transparent extends about 360 degrees about a circumference of the jar.

3. The method of claim 1, wherein the sealing plate is a spring-loaded center sealing plate.

4. The method of claim 1, wherein the top includes a center cap which, when depressed, opens the vent on the side of the top portion, the method including depressing the center cap to open the vent.

5. The method of claim 1, wherein the method includes securing the jar to another object to prevent theft of the jar.

6. The method of claim 5, wherein the jar has a ring extending around the jar with an opening, a tether being secured on one end to the ring at the opening of the ring and secured on the other end of the tether to another object.

7. The method of claim 5, wherein a tether is secured to a base portion of the jar.

8. The method of claim 1, wherein the method includes displaying the jar inside a transparent case or other transparent enclosed structure.

9. A method of displaying botanical contents in a display jar, the jar having a jar lid that has an open position and a closed position, the jar lid being biased toward the closed position, the jar lid having at least one vent on a side of the jar lid, the method comprising the steps of:

moving a spring-loaded center cap on top of the jar lid from the closed position to the open position, whereupon the vent on the side of the jar lid is opened and aroma from inside the jar is released from the jar through the vent; and returning the center cap to the closed position in which the vent on the jar lid is closed and the aroma is sealed within the jar until the vent is opened again;

wherein at least a portion of the jar is transparent, and the method includes placing contents within the jar such that the contents within the jar are visible from outside of the jar; and the center cap is operatively coupled to an internal sealing member such that pressing down on the center cap moves the internal sealing member from a closed configuration sealing the at least one vent on the side of the jar lid to an open configuration permitting aroma to exit through the at least one vent on the side of the jar lid;

wherein the method includes selectively releasing aroma through the at least one vent on the side of the top portion while the contents are visible such that a viewer can both see and smell the botanical contents.

10. The method of claim 9, wherein the jar has a base ring extending around a bottom base of the jar, a tether secured to the base ring on one end of the tether, the tether being secured on another end of the tether to another object, to prevent theft of the jar.

* * * * *